United States Patent [19]

Langenbahn

[11] Patent Number: 4,603,895

[45] Date of Patent: Aug. 5, 1986

[54] COMBINATION PADDED SECURITY LOCK AND CARRIER THEREFOR

[76] Inventor: Albert Langenbahn, 704 S. Morgan, Mason City, Ill. 62664

[21] Appl. No.: 634,326

[22] Filed: Jul. 25, 1984

[51] Int. Cl.[4] ..... E05C 19/18

[52] U.S. Cl. ..... 292/295; 292/292

[58] Field of Search ..... 292/292–298

[56] References Cited

U.S. PATENT DOCUMENTS

| | | | |
|---|---|---|---|
| 552,394 | 12/1895 | Potter | 292/295 |
| 894,179 | 7/1908 | Bins | 292/296 |
| 1,038,690 | 9/1912 | Vincent | 292/292 |
| 1,082,121 | 12/1913 | Herman | 292/294 |
| 1,166,692 | 1/1916 | Kennedy | 292/292 |
| 1,418,593 | 6/1922 | MacKellar | 292/295 |
| 1,772,252 | 8/1930 | Henry | 292/297 X |
| 3,161,428 | 12/1964 | Zook | 292/292 |
| 3,589,761 | 6/1971 | Lambert | 292/292 |
| 4,155,578 | 5/1979 | Rolland | 292/292 |

*Primary Examiner*—Robert L. Wolfe
*Assistant Examiner*—Russell W. Illich
*Attorney, Agent, or Firm*—Edwin E. Greigg

[57] ABSTRACT

An improved simplified portable padded security lock and carrier in combination for use with hinged doors comprising a lock bar provided with a slot medially thereof, an end bent out of the plane of said lock bar and an opposite end provided with ears or a tang to engage the latch aperture in the door jam striker plate. The lock bar is inserted through a padded lock body via a slotted aperture therein adjacent an enlarged portion in the end of the padded lock body, the end being designed to engage a tapered key element upon its insertion through the slot in the lock bar. After insertion of the tapered key element to such an extent as it will pass through the slot in the lock bar, an elastic retention means can be engaged with the opposite side of the lock bar so as to complete the assembly and render it unshakeable from its operative position.

7 Claims, 3 Drawing Figures

COMBINATION PADDED SECURITY LOCK AND CARRIER THEREFOR

BACKGROUND OF THE INVENTION

1. Field of the Invention

This invention relates to door locking or latching devices and more particularly to a novel door latch apparatus which is portable in nature and upon installation protects the door surface against damage.

2. Brief Description of the Prior Art

Many attempts have been made in the prior art to deal with the problem of portable safety door locks which can provide readily useable positive auxiliary door locks for use in locking hotel, motel or other doors on the inside where there is a likelihood of being robbed while sleeping, due to the fact that others may have a duplicate key to the conventional door lock. Several of these prior art devices have provided portable safety door locks which will securely lock most such doors from the inside and can be readily released when and as required.

The most pertinent of the prior art door locks of the same general type may be found in U.S. Pat. No. 1,166,692 to Kennedy, U.S. Pat. No. 3,589,761 to Lambert, or U.S. Pat. No. 4,386,797 to Duran, Sr. Compared to the foregoing prior art, the novel portable safety door lock disclosed herein is less cumbersome and does not damage either the door or door frame to which the device is secured.

Therefore, the prior art has not satisfied the long-standing need which has existed to provide a novel door-latching apparatus which may be readily carried from place to place by the user, which is totally self-contained to the extent that a portion of the lock means also serves as a carrier, and which may be installed with no particular expertise or knowledge and without special tools, and yet serves to protect the door and the door frame from damage from the lock itself.

OBJECTS AND SUMMARY OF THE INVENTION

Accordingly, the above problems and difficulties are obviated by the present invention which provides a novel door latch apparatus for releasably securing a door in its closed position and which apparatus includes three simple elements: namely, a lock bar, a padded lock body and a tapered key element. The lock bar is formed so as to be positioned between the edge of the door and door jamb when the door is closed such that an end portion including at least one tang or flange may engage the latch aperture in the striker plate normally secured to the jamb. The lock bar is provided with a slotted aperture to accommodate a tapered key element. The padded lock body comprises an elongated sleeve member provided with a slot complemental to the width of the shank of the lock bar and through which slotted aperture the lock bar passes in a normal relation such that an enlarged padded end of the padded lock body rests between the door and the tapered key element when the latter is inserted in the slot in the lock bar. Finally, the tapered key element is provided with an elastic retention means designed to be slipped over the lock bar to retain the tapered key element in the lock bar should the door be forced or shaken in an attempt by an outsider to dislodge or otherwise overcome the lock.

It is an object of the invention therefore to provide a security lock which includes in combination a carrier and padding element which serves to protect the door which is locked by the security lock.

It is another object of the invention to provide a security lock wherein one of the pieces of said lock serves as the carrier for the remaining pieces of the lock.

It is still another object of the invention to provide a novel lock means which is adjustable to suit any door and striker plate combination.

It is a still further object of the invention to provide a security door lock including means which retains the lock in its locked position against the possibility of being dislodged or overcome should the door be jiggled, shaken or otherwise forced.

Other objects and advantages of the invention will become apparent by reference to the description and the accompanying drawings.

BRIEF DESCRIPTION OF THE DRAWINGS

The present invention may best be understood by reference to the following description, taken in connection with the accompanying drawings, in which.

DESCRIPTION OF THE PREFERRED EMBODIMENT

Figure 1:
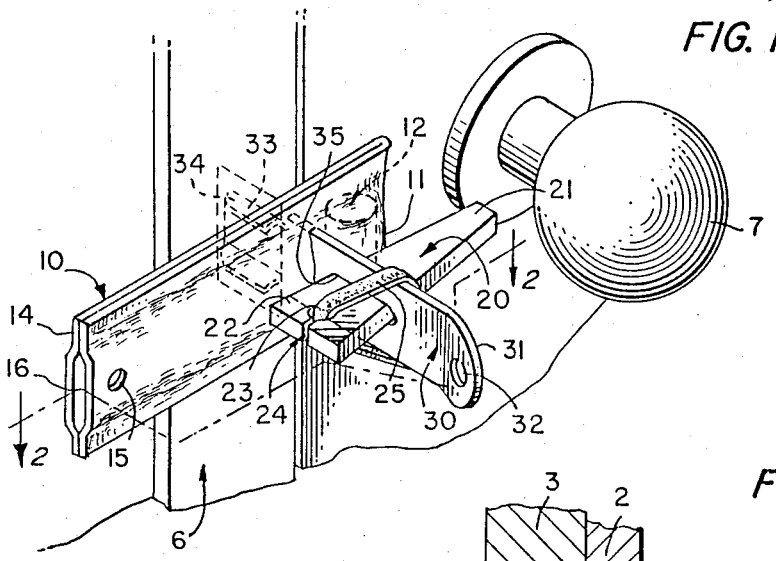
FIG. 1 is a perspective view of a door lock constructed in accordance with the invention, the lock being shown as installed in its operative position.

Referring to FIG. 1, reference numeral 10 designates generally the padded lock body in its "as installed" position against the face of a door 1 and a conventional trim strip associated therewith, indicated at 6. The lock body is shown with an enlarged portion 11 resting against the face of the door 1 with the tapered key element, indicated generally by 20, mounted exteriorly of that enlargement through the lock bar, indicated generally by 30. The end 11 of the padded lock body 10 encompasses or encapulates an element 12 which serves to enlarge in a substantially circular fashion the end 11 of the padded lock body. This enlarged portion of the padded lock body serves to pad the door surface against abrasion or other damage from the tapered key element 20 whose tapered end portion 21 rests against the enlargement 12 in its installed, operative position and to provide a heel upon which the tapered key element 20 rests during securely locking the door.

Figure 2:
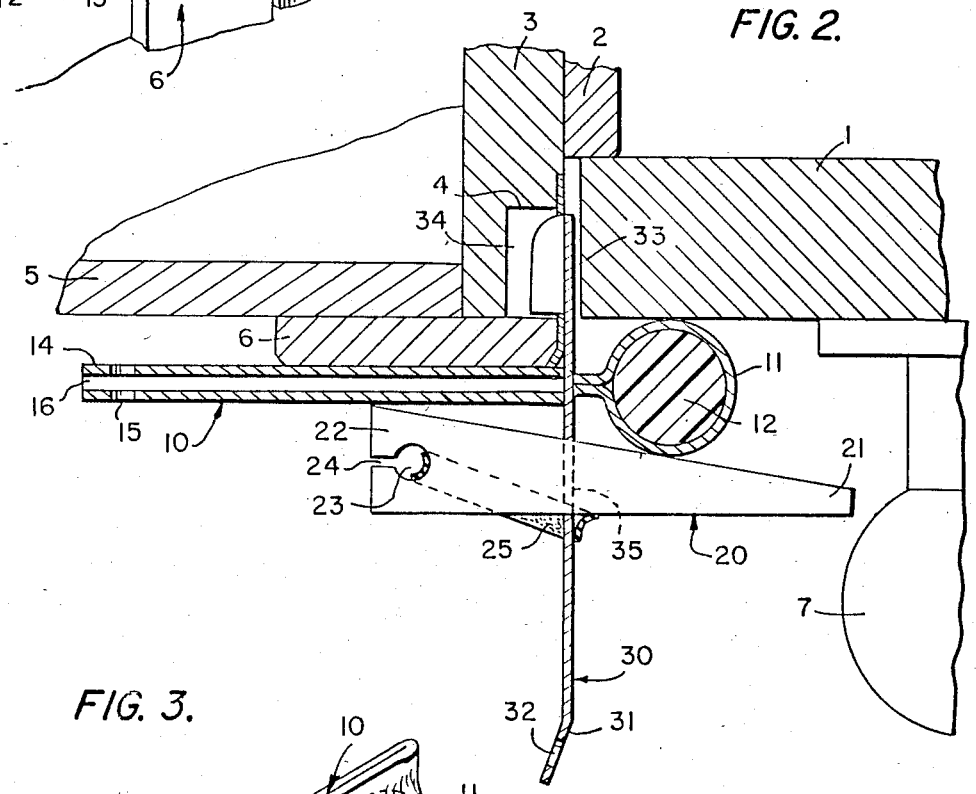
FIG. 2 is an enlarged detailed cross sectional view of the lock shown in its installed operative position as viewed from the top.
Figure 3:
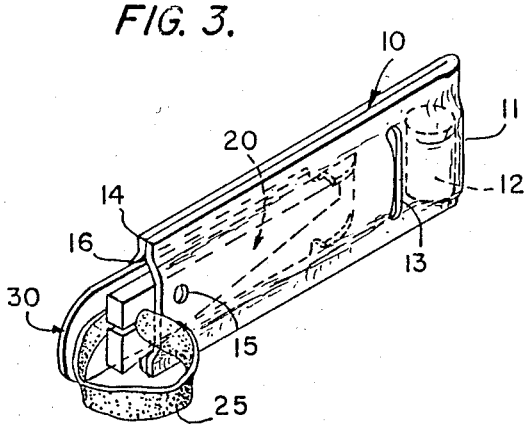
FIG. 3 is a perspective view of the security lock according to the invention in its transportable position, wherein the lock bar and tapered key element are shown inserted in a sleeve of the padded lock body.

As best shown in FIG. 3, the padded lock body is possessed of a slotted aperture adjacent to the enlarged portion 12 in the end 11 of the lock body, the slotted aperture 13 lying in normal relation to the access of the lock body. The slotted aperture 13 is designed to allow the lock bar, indicated at 30 in FIGS. 1 and 2, to pass through the padded lock body so as to be oriented in the latch aperture of the striker plate in the door jamb between the jamb and the door when the door is in a closed position.

Referring again to FIG. 1, it can be seen that the padded lock body 10 is provided with an end 14 in one of the sleeve surfaces of which is provided an aperture 15, upon which the padded lock body may be hung, as from a nail, and an aperture 16 formed as a sleeve between the surfaces of the padded lock body. The padded lock body produced in accordance with the invention could comprise a single sheet of flexible material rebent upon itself, encapsulating the enlarging element at one end and glued or otherwise joined along its surface edges so as to form a sleeve for reception of the other lock pieces, namely, the lock bar 30 and the tapered key element 20.

In its installed position, as shown in FIG. 1, the lock bar indicated as 30 is shown provided with an end 31 which is bent out of the plane of the lock bar itself and away from the door knob 7, the end portion 31 being provided with an aperture 32, which when stored in the padded lock body can be aligned with aperture 15 for storage, as by hanging on a nail. The lock bar is further provided with an opposite end 33 into which at least one tang or ear is provided at right angles to the plane of the lock bar, the tang being arranged for reception by the latch aperture in the striker plate, as it is mounted in the door jamb of a door. The lock bar is further provided with a slotted aperture 35 designed to receive the tapered key element 20 in the installed lock position. The arrangement of the lock bar, padded lock body and tapered key element can perhaps be best viewed from FIG. 2.

In FIG. 2, the tapered key element 20 in its installed position is shown to have a tapered portion 21, lying adjacent the door knob 7 of the door 1, and to have an opposite extremity of larger section into which an aperture 23 is provided and a slot 24 leading into aperture 23, through which slot an elastic means 25, or rubber band, can be introduced for permanent reception within said aperture so as to form a part of the tapered key element. As is shown in FIG. 2, in its installed position the tapered key element is introduced into the slot 35 in the lock bar as far as it will go and the rubber band or elastic means wrapped over the bent end 31 of the lock bar and drawn down to meet the tapered key element to form a positive lock so that the tapered key element cannot be shaken free or dislodged from the lock bar 30.

To operate and install the lock, the lock bar will be introduced through the slot 13 in the padded lock body, and with the door open, the tangs or ears 34 on the lock bar would be introduced into the latch aperture in the striker plate in the door jamb. The door would then be closed and the padded lock body brought into an abutting relation with the surface of the door and the door trim strip. Thereupon, the tapered key element 20, via its tapered portion 21, would be introduced into the lock bar 30 through aperture 35 as far as the tapered key element would go. The extent to which the tapered key element would pass through the slotted aperture 35 would depend upon the thickness of the trim strip and the thickness of the enlarged portion on the padded lock body. When the tapered key element was fully introduced and seated in the lock bar, the elastic retention means or rubber band 25 could be brought over end 31 of lock bar 30 and seated against the lock bar and tapered key element as shown in FIG. 2. The fully assembled and installed lock would then provide protection to the door in its installed position and yet restrain any attempts to open the door or to dislodge the tapered key element from aperture 35 in the lock bar 30 by shaking, reciprocating, or otherwise forcing the door backwardly or forwardly.

In order to remove and disengage the security lock, the foregoing process would substantially be reversed and the lock could be disengaged very quickly, should an emergency or other exigent situation arise.

While particular embodiments to the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

What is claimed and desired to be secured by Letters Patent of the United States is:

1. A combination padded security lock and carrier therefor for use with a hinged door assembly, said door assembly comprising a door provided with a knob-releasable spring latch cooperating with a door jamb provided with a striker plate, said striker plate being provided with a latch receiving aperture in alignment with said spring latch, said padded security lock comprising:

a lock bar having first and second flat surfaces and at least one tang adjacent to an end of said lock bar, and an aperture in the opposite end thereof, said at least one tang off-standing perpendicularly from said first surface and extending in a longitudinal direction and being adapted for emplacement in said latch receiving aperture, said lock bar being interposable between said door and said jamb as said door is closed with said first surface in abutment with said jamb so that said tang is retained in said latch aperture, a smooth surface tapered key element, said lock bar being provided with a longitudinally extending slot means extending from said first surface to said second surface arranged to receive said tapered key element;

a lock body comprising an open ended elongated sleeve member having surface areas and a heel element encapsulated in a pocket in a closed end thereof, said lock body being provided with a transverse slot means juxtaposed said heel element and arranged to receive said lock bar normal thereto so as to abut said door when closed;

said tapered key element adapted to be positioned in a horizontal direction in said longitudinal slot means in said lock bar in abutting parallel relation with said lock body including said heel element with said lock body and said heel element between said tapered key element and said door with one end of said tapered key element forced against said heel element so as to protect said door from marring by said tapered key element while serving to lock said door, said tapered key element having an extensible retention means secured thereto and extendable over said lock bar to urge said tapered key element into said longitudinal slot whereby the key element is urged into a positive locking position whereby undesired opening of said door would be prevented should said door be shaken in an attempt to dislodge said padded security lock.

2. A padded security lock as claimed in claim 1, wherein said sleeve member comprises a flat elongated strip of flexible material.

3. A padded security lock as claimed in claim 1, wherein said hollow sleeve forms a carrier for insertion of said lock bar and said tapered key element whereby a unitary structure suitable for storage and transport is obtained.

4. A padded security lock as claimed in claim 1, wherein said extensible retention means comprises an elastic band.

5. A padded security lock as claimed in claim 1, wherein said end of said lock bar including said aperture includes a bent portion extending out of the plane of said lock bar to facilitate disengagement of said retention means from said lock bar.

6. A padded security lock as claimed in claim 1, wherein said at least one tang comprises a pair of ears lying in spaced parallel relation perpendicular to said first surface of said lock body.

7. A padded security lock as claimed in claim 2, wherein said flexible material is leather.

* * * * *